US005181777A

United States Patent [19]

Segill et al.

[11] Patent Number: 5,181,777

[45] Date of Patent: Jan. 26, 1993

[54] ASSEMBLY SYSTEM FOR A LIGHTING FIXTURE

[75] Inventors: William Segill, Newton; Mark E. Segill, Framingham; Michael Dangelo, Seekonk, all of Mass.

[73] Assignee: American Lighting Fixture Corp., Taunton, Mass.

[21] Appl. No.: 690,602

[22] Filed: Apr. 24, 1991

[51] Int. Cl.[5] ..... F21S 1/06

[52] U.S. Cl. ..... 362/405; 362/457; D26/154

[58] Field of Search ..... 362/147, 404, 405, 406, 362/382, 806, 408, 409, 332, 339; D26/86, 154, 152; 248/317; 59/78; 428/28; 63/4

[56] References Cited

U.S. PATENT DOCUMENTS

| | | | |
|---|---|---|---|
| 182,668 | 9/1876 | Hobbs . | |
| D. 197,858 | 3/1964 | Harper . | |
| D. 201,907 | 8/1965 | Welhofer et al. . | |
| D. 209,075 | 10/1967 | Welhofer . | |
| D. 214,751 | 7/1969 | Friedman et al. . . | |
| D. 305,695 | 1/1990 | Segill et al. . | |
| D. 307,643 | 5/1990 | Segill et al. . | |
| 1,668,772 | 5/1928 | Kestell | 362/405 |
| 3,629,571 | 12/1971 | Schonbek | 362/457 |
| 3,943,353 | 3/1976 | Tada . | |
| 3,979,584 | 9/1976 | Fossati | 362/405 |
| 4,107,770 | 8/1978 | Weber | 362/405 |

FOREIGN PATENT DOCUMENTS

| | | | |
|---|---|---|---|
| 244121 | 3/1963 | Australia | 362/405 |
| 322910 | 7/1989 | European Pat. Off. | 362/382 |

OTHER PUBLICATIONS

Hacolite Co. Inc. Decorative Lighting Catalog, 1953, p. 34.

Home Lighting & Accessories, Feb. 1989, p. 151, Crystal Lamp Parts, Lead Crystal.

Spencer Light Fixture Catalog, p. 24, Chandelier Crystal.

Triarch Industries "Swirl Collection" Lighting Fixture Catalog 1988, Front Cover, Chandelier.

*Primary Examiner*—James C. Yeung

*Attorney, Agent, or Firm*—Wolf, Greenfield & Sacks

[57] ABSTRACT

A lighting fixture, particularly a ceiling fixture adapted to surround a source of illumination, includes a horizontal mounting bracket with a set of upwardly open recesses formed in its upper edge. The bracket is preferably formed from a strip with a rectangular cross section, has overall a closed loop configuration, and is oriented with the recesses formed in a narrow edge surface of the strip. A set of translucent members are replacably assembled to the bracket without rivets or welding by a set of attachment members each have a hooked, upper end portion that seats in an associated one of the recesses. The seating is preferably snug and the hooked portion sandwiches the bracket below the recess to provide mechanical stability. The translucent member is preferably secured to the attachment member at a closed hole formed in the lower portion of the body by a conventional fastener that engages the hole and the translucent member.

13 Claims, 2 Drawing Sheets

ASSEMBLY SYSTEM FOR A LIGHTING FIXTURE

BACKGROUND OF THE INVENTION

This invention relates in general to lighting fixtures and more specifically, to a system for assembling a translucent or transparent elements into a three dimensional array. Modern, high fashion lighting fixtures for home or business use can be formed by suspending a three dimensional array of crystals or pieces of some other translucent material organized about, or with, a light source or sources. The most common form is a set of crystal, glass or plastic elements that surround a set of electric light bulbs at the center of the fixture with the entire fixture suspended by a chain or cable from a ceiling. (In this application, these elements will be referred to as "crystals" even though they may not be formed of crystal.) The individual crystal pieces are typically attached to a rigid frame which is attached to the chain or cable. The frame can take a wide variety of forms, such as a central vertical member with radial branches, but the most common form is a closed loop metal member, or a set of vertically spaced such members that support the crystals. The assembly system to mount the crystals on the fixture must serve a variety of design objectives, but central to the success of the system is the ability to hold the crystals in place during mechanical jostling, as during hanging, cleaning or maintenance, and the ability to accurately and reliably secure the crystals in a predetermined location and with a predetermined orientation.

Heretofore, there have been two general approaches to the assembly of the crystals for such a fixture. One approach is to assemble the crystals and the bracket as a single unit at the factory. This avoids assembly after shipment and can lead to a "cleaner" design than with on site assembly, but there are increased manufacturing costs to assemble the complete fixture as a permanent unit, it is more costly to ship the fully assembled fixture, and there is an increased likelihood of breakage during shipment. To avoid these problems it is also known to weld, rivet, screw, glue or otherwise permanently secure a metal piece to the bracket. The crystals can be packaged separately for shipment but are secured to the metal pieces as by snap fasteners or wire. This approach allows the crystal to be shipped with a lower likelihood of damage than if pre-assembled, and offers a compact shipping configuration. However, the welding, riveting, screwing or other permanent assembly technique increases the cost of manufacture and the attachment can be unattractive.

It is also possible to assemble crystals to a bracket on site using relatively simple and inexpensive wire hooks, loops and the like. Besides being relatively unaesthetic in appearance, such a system does not provide a high degree of stability and it can be difficult to locate and orient the crystals with accuracy and reliability, particularly where the crystals are generally planar and their orientation and location is important to achieving the overall design of the fixture. Also, it is a time consuming process that involves a great deal of handling of the crystals by the assembler. The risks of breakage of the crystals. Especially in the hands of an unskilled installer, are substantial.

It is therefore a principal object of this invention to provide an assembly system for a gravity-suspended multi-crystal fixture which allows rapid on-site assembly without special tools or skill, and which also accurately and reliably positions and orients the crystals in a predetermined three dimensional array.

It is a further principal object of this invention to provide such an assembly system which mounts the crystals with a high degree of stability, despite mechanical agitation associated with installing the fixture, cleaning it or changing the light bulb(s).

Another principal object is to provide an assembly system with the foregoing advantages that also provides low shipping costs for the fixture and shipment in a mode that minimizes the likelihood of damage to the crystals.

Still another object is to provide the foregoing advantages with a high degree of ease of assembly and allows the ready replacement of a damaged crystal or crystals.

Yet another advantage is to provide an assembly system that reduces the cost of manufacture as compared to conventional bracket-and-suspended crystal ceiling fixtures.

A still further advantage is to provide an assembly system with all of the foregoing advantages which provides an assembled lighting fixture that has a highly "clean" and aesthetically pleasing appearance.

SUMMARY OF THE INVENTION

An assembly system for a light fixture suspends a three-dimensional array of crystals in conjunction with a source or sources of illumination, typically one or more electric light bulbs. The system includes at least one support member or bracket that is oriented horizontally and suspended from the ceiling, beam, wall, bracket or the like by a chain, cable, wire or like component. Alternatively the bracket can be supported via an assembly that rests on a light bulb or on another assembly that in turn supports the light bulb(s). The bracket is preferably a strip of structural material with a rectangular cross-section. It is oriented with its broad faces at its outer and inner sides and its narrow edges at the top and bottom. In a preferred form the strip is a single closed loop fabricated with a butt weld and has a polygonal shape when viewed in the horizontal plane.

The assembly system also includes (i) a set of open, upwardly facing recesses formed in the upper surface of the bracket and (ii) a like set of attachment members. Each attachment member has a hook like upper end portion that engages the bracket in an associated end of the recesses and a body that secures one or more crystals, preferably at a lower end portion. The attachment members are preferably formed from a strip of structural sheet material of rectangular cross-section with a planar body portion and an upper portion formed by bending the strip into a J configuration. A curved section of the upper end portion seats closely in the associated recess. A free end section is in a parallel relation with the body portion of the attachment member and preferably spaced by a distance the same as, or slightly greater than the thickness of the bracket below the recess. The spacing may be smaller provided the resiliency of the material can accommodate the thickness. When assembled, this arrangement provides a slight spring force to secure the assembly. The width of the attachment members, the face-to-face engagement of the upper end portions with the bracket, and a close fit of the attachment member in the recess allow assembly of the crystals to the bracket without welds, screws, rivets or the like, yet provide a high degree of stability even during hanging, cleaning or maintenance of the fixture.

The crystals can be replaceably secured to the attachment members using a closed hole formed in the body and a snap or closed loop wire fastener. The attachment member is assembled to the bracket with a simple downward sliding engagement. The weight of the crystal and the attachment member and the friction between the attachment member and the bracket secure the attachment member in its associated recess. The recesses are preferably generally rectangular and have a depth that leaves the top edge of the assembled attachment member even with the upper edge of the bracket.

These and other features and objects will be more fully understood from the following detailed description which should be read in light of the accompanying drawings.

DETAILED DESCRIPTION OF THE PREFERRED EMBODIMENTS

Figure 1:
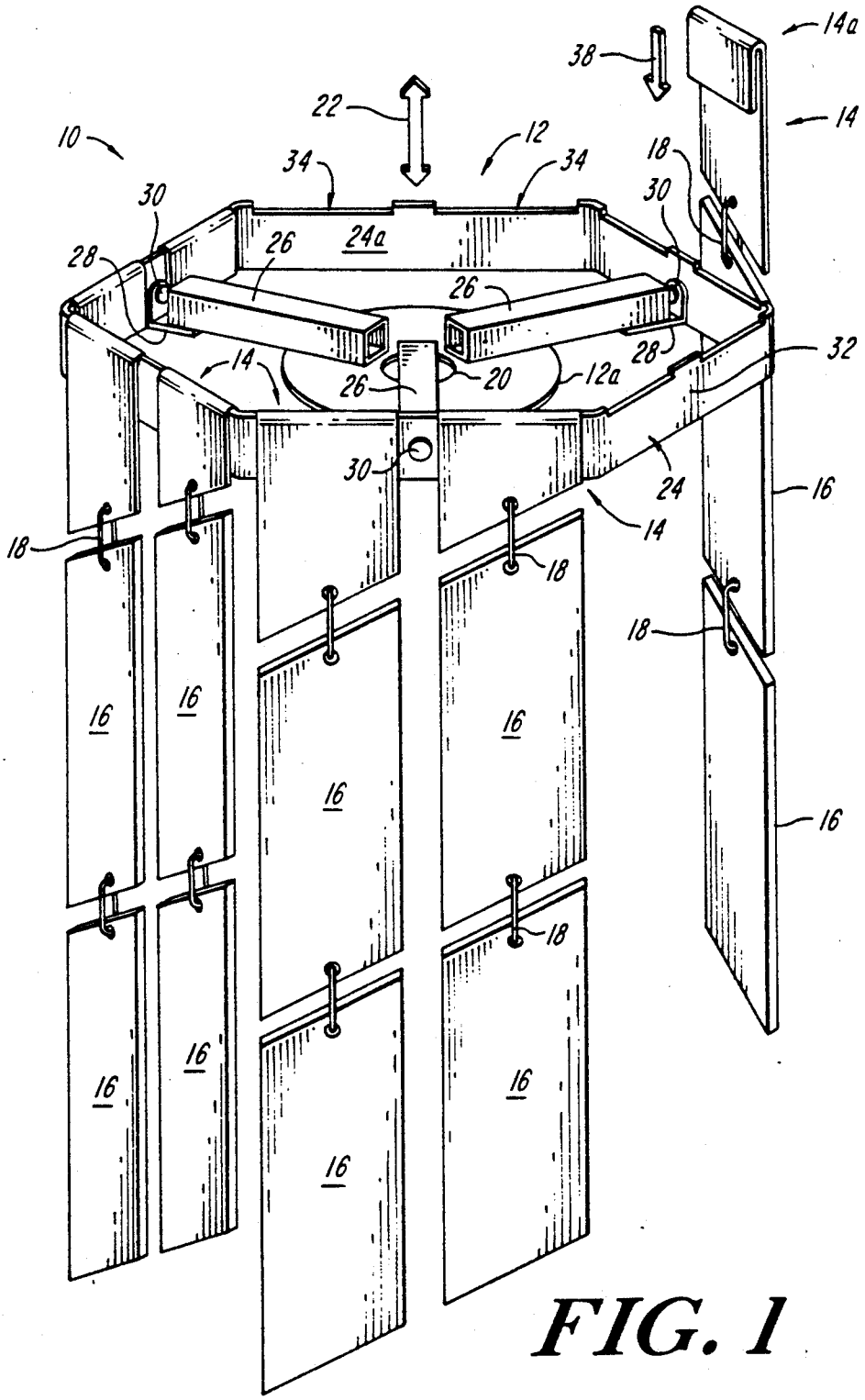
FIG. 1 is a view in perspective of a lighting fixture utilizing the assembly system of the present invention.
Figure 3:
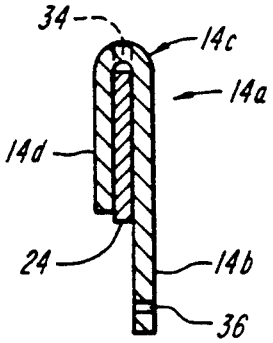
FIG. 3 is a detailed view in vertical section taken along the line 3—3 in FIG. 2 showing the engagement of an attachment member to the bracket in a recess.
Figure 2:
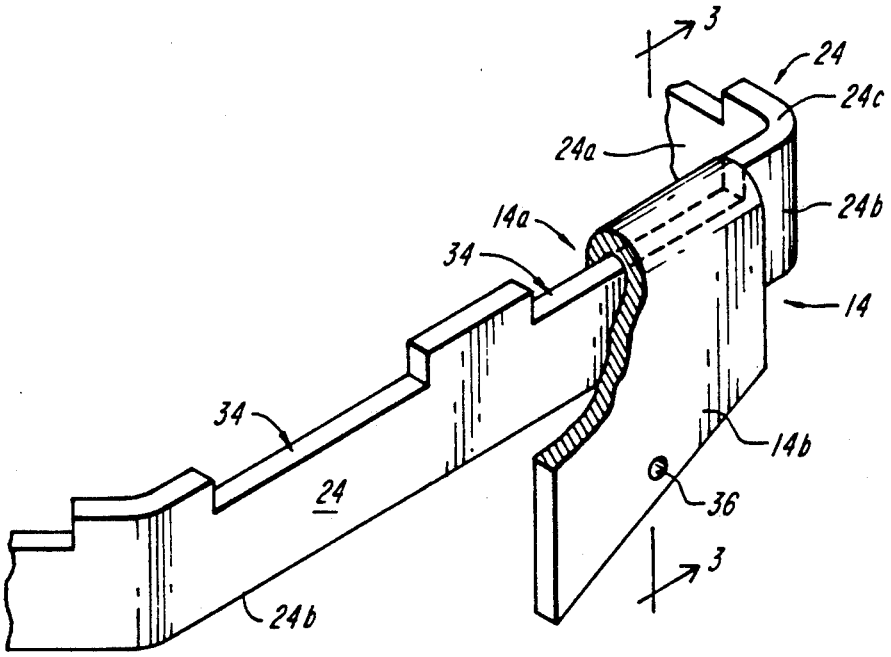
FIG. 2 is a detailed view in perspective, with portions broken away of the assembly system shown in FIG. 1.

FIGS. 1-3 show a lighting fixture 10 including a frame 12, attachment members 14, and crystals 16 suspended from the attachment members by closed wire loops 18 to form a three dimensional array of the crystals about a central source of illumination (not shown) such as an electric light bulb that projects base-upwardly through a central opening 20 in a circular plate 12*a*. The fixture 10 can be supported from the bulb when it is screwed into a socket, or it can be suspended in any well known manner using cable(s) or chain(s) secured at an upper end to a ceiling mount and at a lower end to the frame 12. The precise form of attachment of the fixture to the ceiling or other support is not a part of this invention. The crystals 16 are translucent or transparent pieces of crystal, glass, plastic or the like and the term crystal is used herein to include all such materials and such elements regardless of their geometry and light transmitting and/or reflecting qualities. However, this invention is particularly useful in creating an array of crystals 16 where the orientation as well as the location of the crystal is important to the overall design and must be stabilized and maintained with reliability. For example, in the form illustrated in FIG. 1, the crystals are generally planar and oriented to hang from the frame 12 in an array with one face of each crystal 16 directed toward a central vertical axis 22 of the fixture and the opposite face of the crystal directed radially outwardly.

The frame 12 includes a generally horizontally extending, closed loop bracket 24 centered on the axis 22 and supported by a set of radial arms 26 of the frame each welded or otherwise secured at one end of the plate 12*a* and at the other end to a mounting clip 28 that in turn is secured to the frame 24 by a rivet 30. The bracket 24 is preferably formed from a structural sheet material such as steel or brass which is stamped, formed and butt welded at 32. The bracket has an inner face 24*a*, an outer face 24*b*, and upper edge surface 24*c*, and a lower edge surface 24*d*. The frame has a sufficient thickness and height to provide mechanical stability when supporting an array of crystals 16. By way of illustration but not of limitation, a suitable bracket 24 has a height of abut 5/8 inch a width of about 1/16 inch. In the illustrated embodiment, the frame 24 is hexagonal.

The upper edge 24*c* contains a series of mutually space upwardly open recesses 34. In the preferred form shown, the recesses extend radially through the bracket 24 and have a generally rectangular configuation when viewed in side elevation. The recesses 34 can be fabricated inexpensively, as by stamping prior to forming the bracket into a closed loop and welding it at 30. Each recess is sized to receive and seat an upper portion 14*a* of one attachment member 14. In particular, the depth of the recess measured vertically is preferably about equal to the height of the portion 14*a* when seated in the recess so that the upper edge 24*c* is roughly even with the uppermost surface of a curved section 14*c* of the portion 14*a*, as is best seen in FIG. 3. The curved section 14*c* itself is preferably U-shaped.

The attachment member 14 is preferably formed from a strip of structural sheet material of the same material and finish as used to form the bracket 24 in order to provide a uniform appearance. (Both the bracket 24 and the attachment members can have a polished, painted or plated finish to enhance their appearance.) The material and its thickness should be of sufficient strength that when bent over as at the end portion 14*a*, the member 14 will reliably support the weight of one or more crystals 16 and not deform during assembly, or after assembly, when mechanical forces are applied to it. The member 14 has a generally planar downwardly projecting body portion 14*b* which, as shown, can be of varying lengths to conform to the overall design of the fixture. A closed hole 36 formed in the body 14*b* near its lower edge receives the wire loop 18 to secure a crystal 16 to it and thereby suspend it and assemble it to the bracket 24 and the frame 12. The upper end portion 14*a* includes a free end portion 14*d* which is in a parallel spaced relationship with the body portion 14*b*. The spacing is set by the curved section 14*c* and is preferably at or near the value of the thickness of the bracket 24, as shown in FIG. 3.

The member 14 is assembled to the bracket with a downward sliding movement, as indicated by arrow 38 in FIG. 1, with the member 14 position over and located by an associated recess 34. The material forming the member 14 can have sufficient resiliency to provide a slight clamping force against the bracket portion sandwiched between the attachment member portions 14*b* and 14*d*. This, however, makes a "sliding" assembly somewhat more difficult and may mar the surface of the bracket and/or the attachment members. The spacing therefore preferably provides a close fitting engagement of the portion 14*b* and 14*d* with the intervening bracket portion sufficient to reliably secure the member 14 in a seated position in a recess 34 as shown in FIGS. 13. The lateral width of the recess 34 and the member 14 also serve to stabilize the assembly without the use of welds, screws or rivets. Again by way of illustration but not of limitation, the recess 34 has a vertical depth of about 3/64 inch, a width of 1 and ¼ inch and the attachment members have a thickness of about 1/32 inch. The attachment member, like the bracket 24, can be manufactured by simple stamping, bending and machining operations.

There has been described a simple, yet highly effective assembly system for a suspended light fixture of multiple crystals that are themselves suspended in a three dimensional array. The assembly system avoids any rivets, screws, welds or the like to secure the crystals to the bracket. The crystals are automatically and reliably positioned. Assembly requires no special tools or skills. The components of the system are readily manufactured at a favorable cost. The fixture can be disassembled for shipment in a safe manner, and assembled on-site, at the point of end-use. The system also lends itself to the ready replacement of any crystal or crystal of the fixture that is damaged after installation. The assembly system is also aesthetically pleasing and flexible to accommodate a wide variety of design objectives.

While the invention has been described with respect to its preferred embodiments, it will be understood that various modifications and alterations will occur to those skilled in the art from the foregoing detailed description and the accompanying drawings. For example, the recesses 34 can be cut into the rear face of the bracket with no break in the outer upper edge of the bracket. Alternatively, a recess 34 can be machined as a hole in the interior of the bracket upper surface provided the material forming the bracket is sufficiently thick. These alternatives are feasible, but they may be aesthetically less desirable or more costly to execute. Similarly, the attachment member has been described in a fairly straight forward strip configuration, but it could assume a wide variety of forms. For example, the hooked end portion can be formed as two straight-walled sections at right angles with each other. Also, the hooked end portion can be formed as a separate piece and secured to the attachment member, which can then extend above the upper edge of the bracket. Further, the attachment member can have a wide variety of configurations such as triangular or T-shaped. These and other modifications and variations are intended to fall within the scope of the appended claims.

What is claimed is:

1. A system for mounting a plurality of free-hanging translucent members in three-dimensional array in conjunction with a source of illumination to form a suspended lighting fixture, comprising:

a horizontally-extending support member formed of a strip of a structural material of generally rectangular cross-section oriented with the two narrow and surfaces at the top and bottom of the member;

a plurality of mutually spaced, open recesses formed in the upper edge of said member and extending through said strip; and a plurality of attachment members having a hooked end portion adapted to seat in one of said recesses with a downward sliding movement and a body portion extending downwardly from said seated end portion, said body portion including means to attach to at least one of said translucent members and having a portion in a face-abutting relationship with an adjacent portion of said strip.

2. The mounting system of claim 1 wherein said support member is a strip of a structural material of generally rectangular cross-section oriented with the two narrow end surfaces at the top and bottom of the member.

3. The system of claim 2 wherein said support member has a polygonal configuration in the horizontal plane and wherein said recesses are formed in the straight sides of the polygon.

4. The system of claim 3 wherein said recesses are rectangular and wherein said attachment members are formed of a strip of sheet material with an end portion that is angled with a first portion that seats in one of said recesses and a second, free end portion that engages one face of said support member.

5. The mounting system of claim 1 wherein said recesses are generally rectangular.

6. The mounting system of claim 1 wherein said attachment members are of a strip of structural sheet material and said end portion is formed integrally.

7. The mounting system of claim 6 wherein said hooked end portion includes a free end portion in a generally parallel, spaced relationship with the body of said attachment member and a generally U-shaped portion that bridges and is integral with said body portion and said free end portion.

8. The system of claim 7 wherein the spacing between the body portion of said strip and said free end portion is about the same as the width of said support member measured horizontally.

9. The system of claim 6 wherein said recesses are generally rectangular notches and wherein the width of said strip is sized to fit closely within said notches;

10. The system of claim 9 wherein the height of said hooked end portion when seated in an associated one of said notices is substantially equal to the depth of said associated notch.

11. The system of claim 1 wherein said attaching means comprises a closed hole formed in a lower end of said body portion and a fastener that engages both said hole on and upper end of said translucent member.

12. A system for mounting a plurality of free-hanging translucent members in three-dimensional array in conjunction with a source of illumination to form a suspended lighting fixture, comprising:

a horizontally-extending support member;

a plurality of mutually spaced, open recesses formed in the upper edge of said member, and a plurality of attachment members formed of a strip of structural sheet having a hooked end portion adapted to seat in one of said recesses with a downward sliding movement and a body portion extending downwardly from said seated end portion, said body portion including means to attach to at least one of said translucent members, said hooked end portion being formed integrally and including a free end portion in a generally parallel, spaced relationship with the body of said attachment member and a generally U-shaped portion that bridges and is integral with said body portion and said free end portion.

13. The system of claim 12 wherein the spacing between the body portion of said strip and said free end portion is about the same as the width of said support member measured horizontally.

* * * * *